US007918351B2

(12) United States Patent
Zimmer

(10) Patent No.: US 7,918,351 B2
(45) Date of Patent: Apr. 5, 2011

(54) QUICK-ASSEMBLY SHELF MECHANISM FOR OPTICAL MEDIA

(75) Inventor: Darren Zimmer, Braintree (GB)

(73) Assignee: Atlas AGI Holdings LLC, Greenwich, CT (US)

( * ) Notice: Subject to any disclaimer, the term of this patent is extended or adjusted under 35 U.S.C. 154(b) by 230 days.

(21) Appl. No.: 12/224,250

(22) PCT Filed: Feb. 23, 2007

(86) PCT No.: PCT/US2007/062648

§ 371 (c)(1),
(2), (4) Date: Aug. 21, 2008

(87) PCT Pub. No.: WO2007/101086

PCT Pub. Date: Sep. 7, 2007

(65) Prior Publication Data

US 2009/0001038 A1 Jan. 1, 2009

Related U.S. Application Data

(60) Provisional application No. 60/775,891, filed on Feb. 23, 2006.

(51) Int. Cl.
*A47G 29/00* (2006.01)

(52) U.S. Cl. ..... 211/40; 211/113; 211/149; 108/165; 206/744

(58) Field of Classification Search ..... 40/124, 40/124.2, 124.4; 211/45, 47, 48, 55, 70.1, 211/126.16, 130.1, 135, 149, 150, 186, 195, 211/113, 40, 41.12; 312/259–261; 108/165; 206/740, 742–744
See application file for complete search history.

(56) References Cited

U.S. PATENT DOCUMENTS

| | | | | | |
|---|---|---|---|---|---|
| 381,889 | A | * | 4/1888 | Scott | 206/254 |
| 1,239,485 | A | * | 9/1917 | Heywood | 248/174 |
| 1,387,209 | A | * | 8/1921 | Stranders | 248/174 |
| 2,097,553 | A | | 11/1937 | Gruenberg | |
| 2,283,406 | A | * | 5/1942 | Bacon | 248/174 |
| 2,661,176 | A | * | 12/1953 | Drueck, Jr. | 248/152 |
| 3,757,934 | A | * | 9/1973 | Taub | 206/768 |
| 4,049,117 | A | * | 9/1977 | Grimm | 206/270 |
| 4,949,851 | A | * | 8/1990 | Shaffer | 211/149 |
| 6,454,106 | B1 | * | 9/2002 | Howard | 211/50 |
| 2004/0148825 | A1 | * | 8/2004 | Myers et al. | 40/124 |

FOREIGN PATENT DOCUMENTS

| | | |
|---|---|---|
| EP | 1 031 304 A | 8/2000 |
| GB | 2 329 890 A | 4/1999 |

OTHER PUBLICATIONS

International Search Report dated Sep. 19, 2007.

* cited by examiner

*Primary Examiner* — Korie Chan
(74) *Attorney, Agent, or Firm* — McDermott Will & Emery LLP

(57) ABSTRACT

A point of purchase display structure (300) is described incorporating one or more shelves (132) for supporting items, wherein the display structure in a partially assembled configuration is a generally flat structure, and may be converted to a finished structure by movement of an inner slide (150) within an outer sleeve (100).

18 Claims, 5 Drawing Sheets

QUICK-ASSEMBLY SHELF MECHANISM FOR OPTICAL MEDIA

REFERENCE TO RELATED APPLICATION

This application claims the benefit of priority under 35 U.S.C. §119(e) of U.S. provisional application Ser. No. 60/775,891, filed on Feb. 23, 2006, which is hereby incorporated by reference in its entirety.

BACKGROUND

This invention relates generally to easily erected displays, and more specifically to an easily erected display for optical media and the like, which ships in a convenient flat package and assembles quickly and simply into a point-of-purchase (POP) display.

Point of purchase display structures are known in the art, typically being temporary paperboard or cardboard structures, often with some printed graphics, and capable of holding a number of product items such as optical media for example CD's and DVD's.

The known POP displays may be shipped as assembled or partly assembled units, but such configurations may occupy excess space, leading to increased shipping costs, and may be vulnerable to damage such as bending or crushing during shipment. Additionally known POP displays may be shipped in flat orientation, but these typically comprise many pieces that require careful assembly at their destination.

What is desirable and is lacking in the art is a POP display fixture which ships in a compact and durable configuration, and assembles quickly and easily upon receipt at a retail store.

SUMMARY

The present invention provides an easily erected POP display structure for optical media or other items. The exemplary structure is made from foldable sheet material such as cardboard, paperboard, plastic, any combination thereof, and the like. The structure is shipped in a partly assembled, flat configuration, and upon being readied for use, is converted quickly into a finished shelf structure.

The invention taught herein includes exemplary embodiments of POP displays, the blank panels for constructing the POP displays, and methods of using POP displays.

In the illustrated embodiment a POP display comprises an outer sleeve configured to substantially wrap around an inner slide panel, and at least one shelf configured from and extendable from the outer sleeve, when elements of the shelf are attached to elements of the inner sleeve panel. Another embodiment, described and taught but not illustrated, is a POP display comprises an outer sleeve with spaced apart receiving channels configured to receive an inner slide panel, and at least one shelf configured from and extendable from the outer sleeve, when elements of the shelf are attached to elements of the inner sleeve panel. The invention includes methods of erecting and using the POP displays described and taught herein.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, material or methods, such as means for fastening and connecting or printing, have not been described in detail in order to avoid obscuring the present invention. Therefore, specific structural and functional details disclosed herein are not to be interpreted as limiting, but merely as a basis for the claims and as a representative basis for teaching one skilled I the art to variously employ the present invention.

Figure 1:
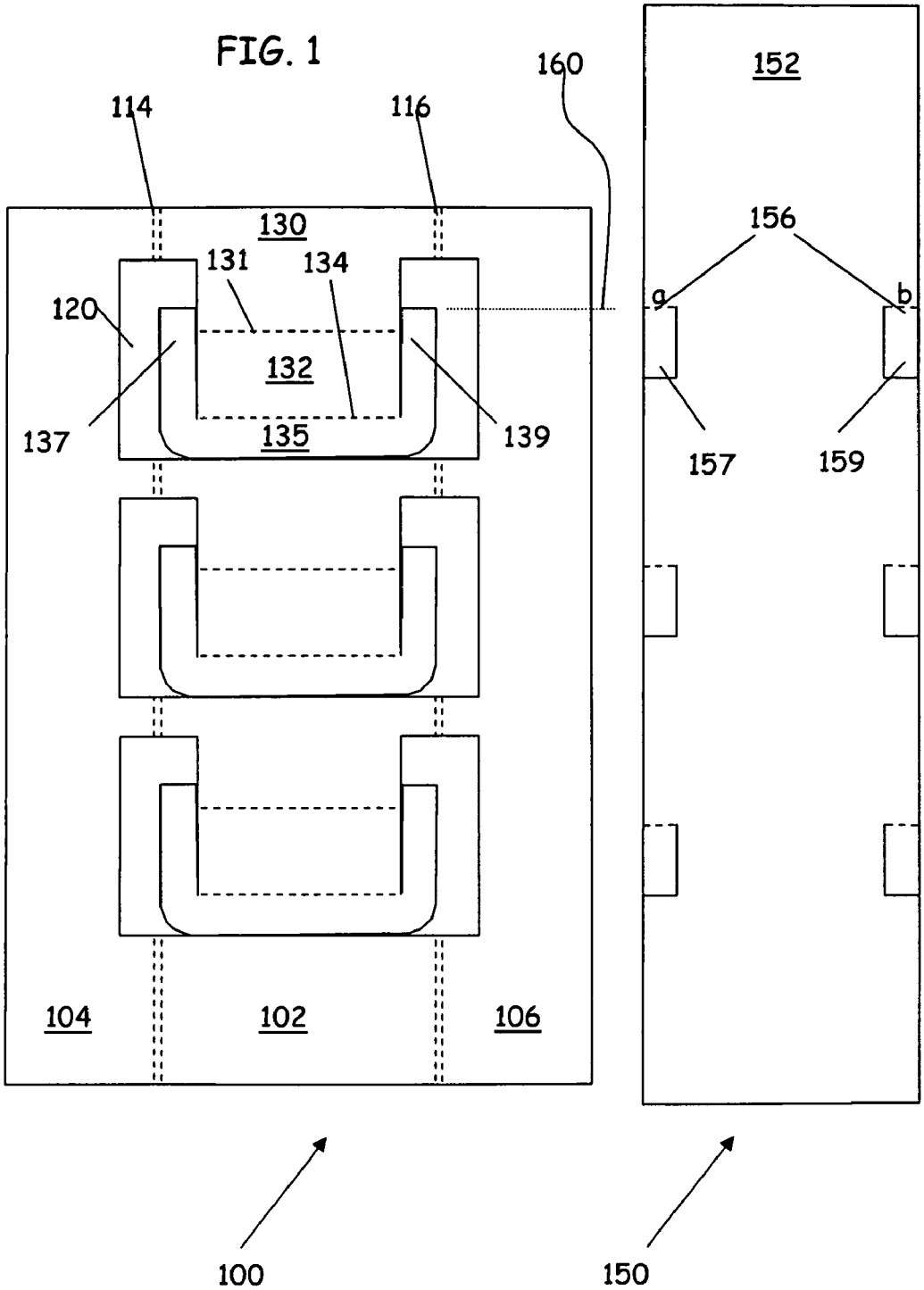
FIG. 1 shows a plan view of two blanks, from which a POP display structure according to this invention is formed.
Figure 4:
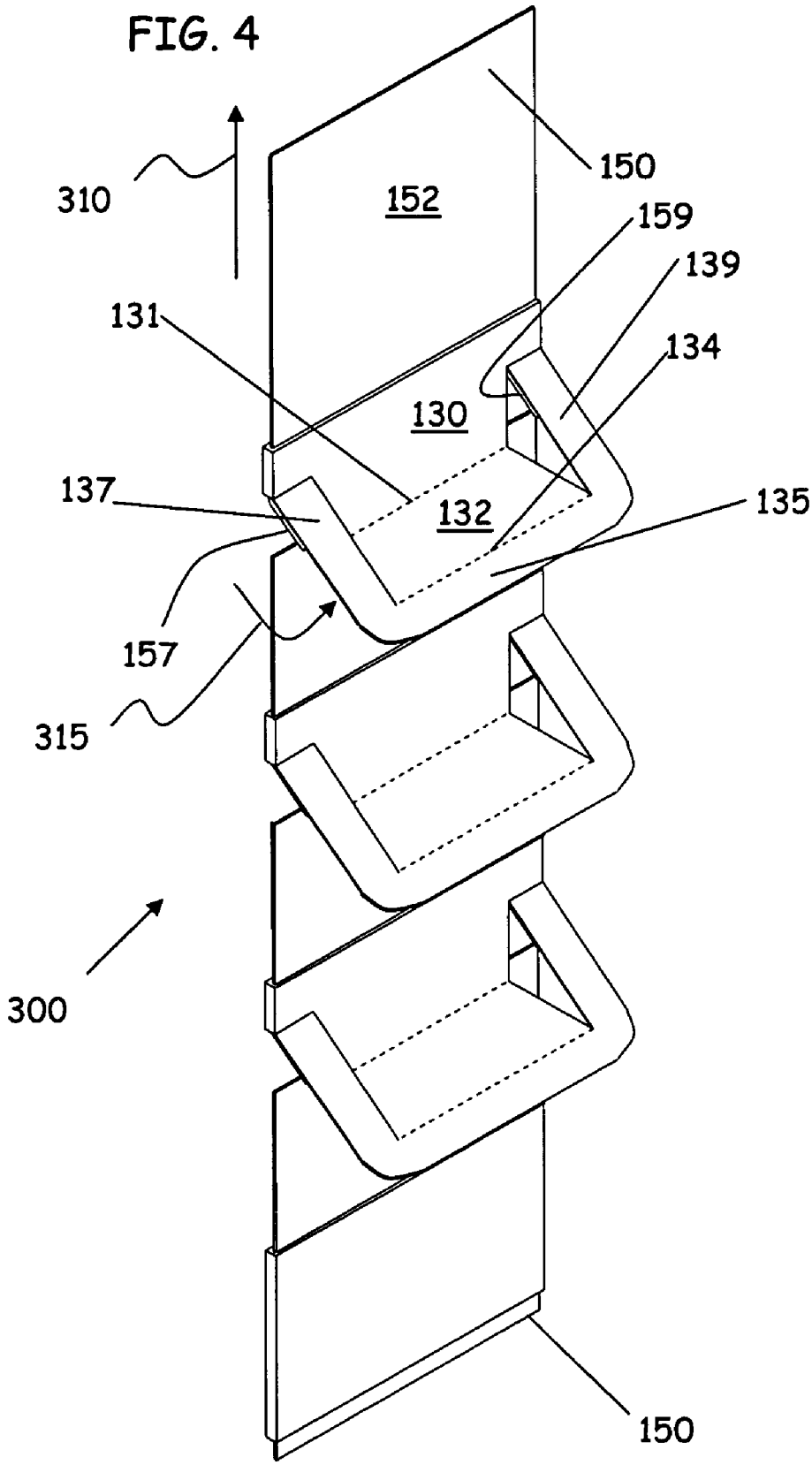
FIG. 4 is a perspective view of the fully assembled configuration of the POP display structure according to the invention.

In FIG. 1, there is shown a plan view of a outer sleeve blank 100 and a inner slider blank 150, which when constructed, form a POP display of FIG. 4 for holding items such as optical media. The blanks may be formed from any suitable sheet material, such as paperboard, cardboard, thin plastic sheet, or the like. The blanks may furthermore contain printed graphics.

Outer sleeve blank 100 comprises a sleeve central portion 102, and sleeve side portions 104 and 106. The sleeve portions are separated from one another by fold or score lines 114 and 116. When inner slider blank 150 is placed behind the outer sleeve blank 100, and the sleeve side portions 104 and 106 are folded back upon fold lines 114 and 116 respectively, the outer sleeve blank 100 partly or fully surrounds the inner slider blank 150.

FIG. 1 shows an example embodiment of the invention wherein three shelves are provided. Only one of the shelves is annotated and described in the assembly process discussed here. It is understood that the invention may comprise more or less than three shelves.

By combination, outer sleeve 100 and inner slider 150 form one or more shelves. Elements will be described which comprise the top shelf as shown in FIG. 1. Each shelf has a ledge 132 that in the finished structure will be an approximately horizontal surface for supporting items. A back fold line 131 separates the ledge 132 from a back surface 130 that will typically be in an approximately vertical orientation in the finished structure. A front fold line 134 separates the ledge 132 from a front lip 135. The front lip 135 helps support the ledge 132. The front lip 135 is attached to support arms 137 and 139. An open (cutout) area 120 surrounds parts of the support arms.

The inner slider 150 comprises a generally flat rectangular portion 152, and, for each shelf, a pair of support tabs 157 and 159, which are attached to the rectangular portion 152 by fold lines 156 at the upper end of each tab. On FIG. 1, the notations "a" and "b" are shown just above the fold lines, to help better explain their positioning in later FIGs.

As a first step in assembling outer sleeve 100 and inner slide 150, an adhesive is applied to each of the support tabs 157 and 159. The inner slide 150 is then placed behind the outer sleeve 100, such that the top of support tab 157 coincides with the top of support arm 137, and the top of support tab 159 coincides with the top of support arm 139, as denoted by line "160." Thus the top of support tab 157 is glued to the back surface of the top of support arm 137. Also the top of support flap tab 159 is glued to the back surface of the top of support arm 139. (Other attachment means, for example staples, may be used along with or instead adhesive).

Next the sleeve side portions 104 and 106 are folded back around the slider 150, along fold lines 114 and 116 respectively. The edges of sleeve side portions 104 and 106, which are now behind the inner slide 150, are preferably joined together by tape or adhesive.

Figure 2:
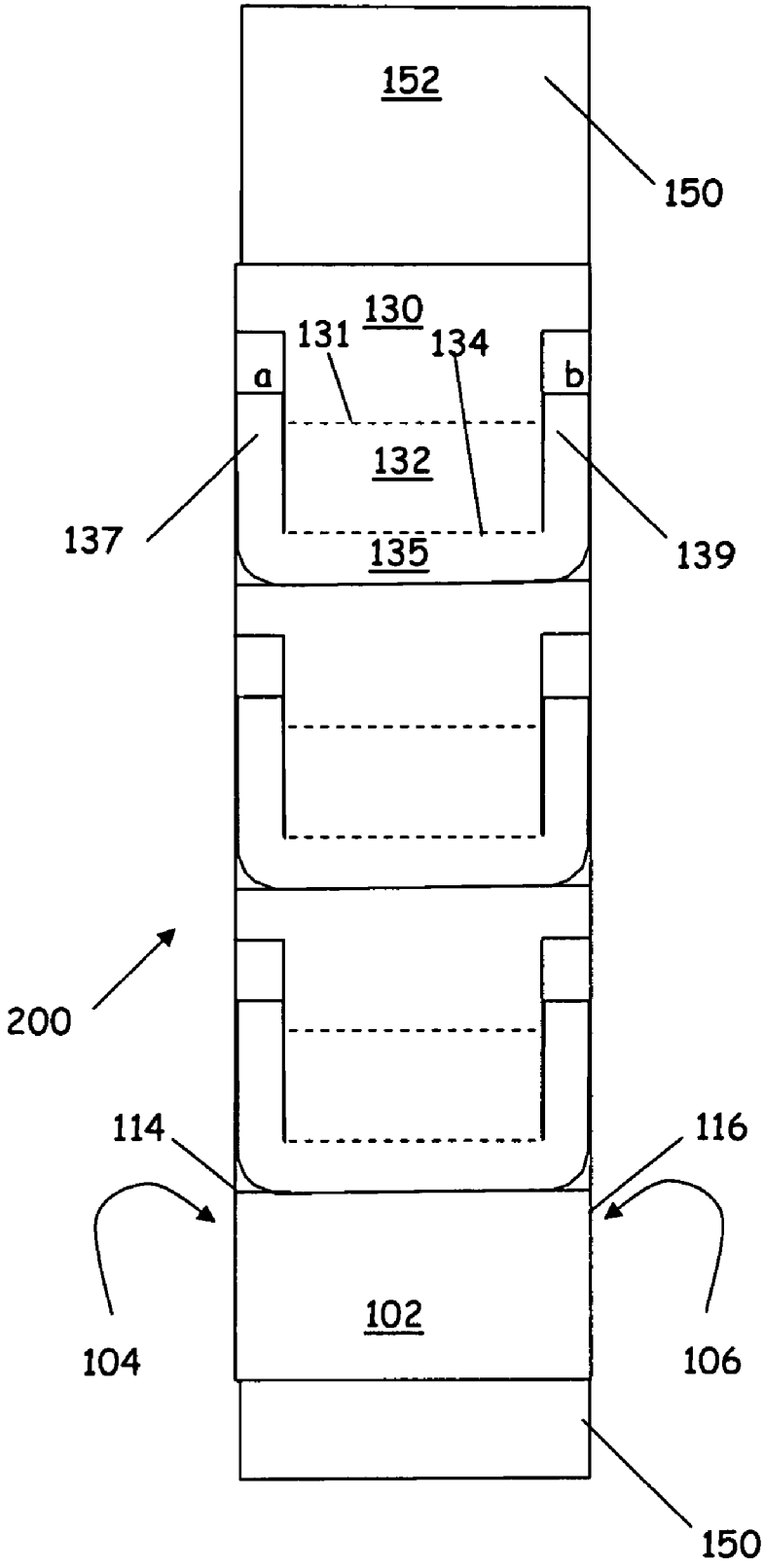
FIG. 2 shows a plan view of the same two blanks, in a partially assembled, flat configuration, from which a POP display structure according to this invention is formed.
Figure 3:
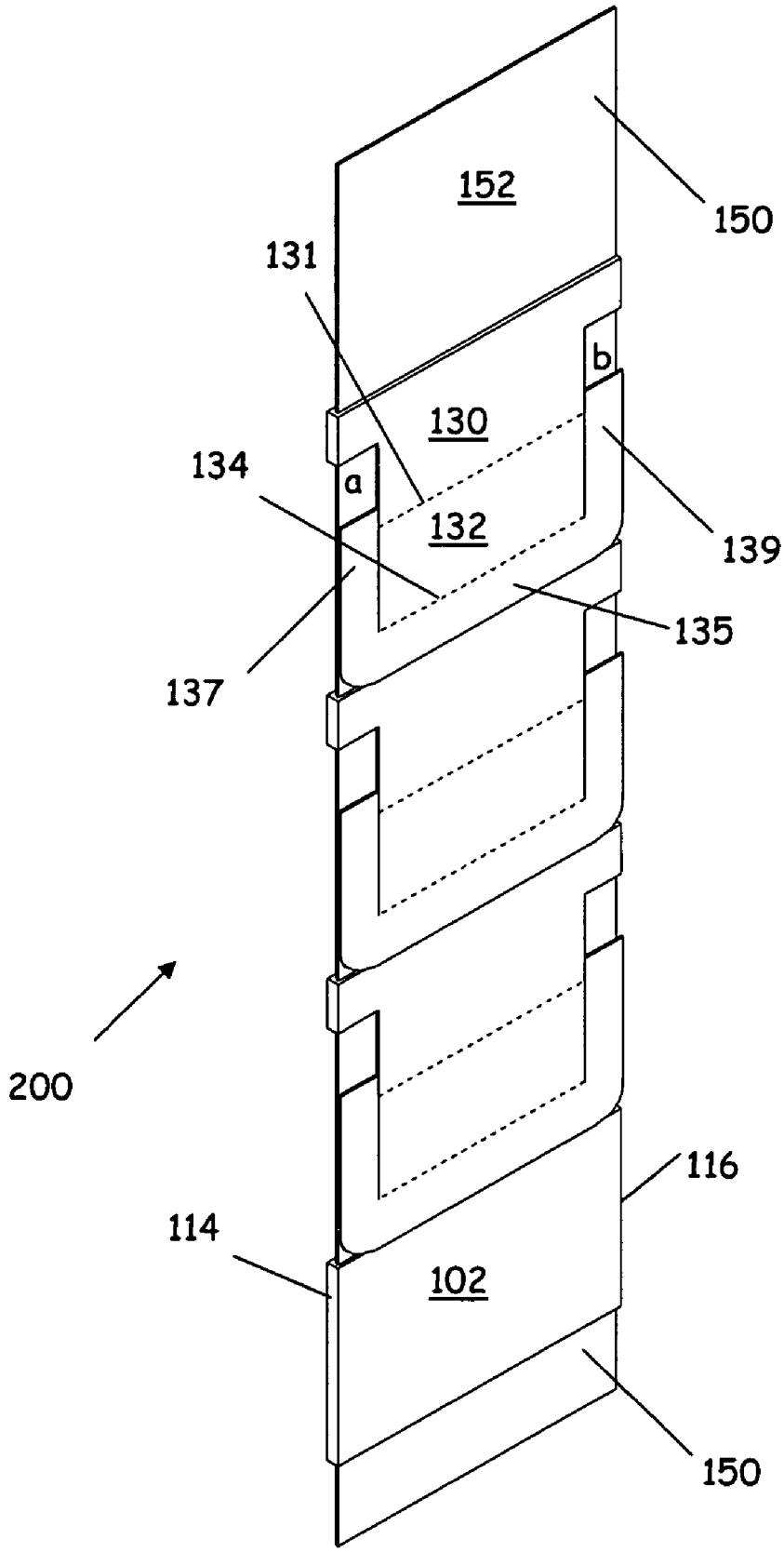
FIG. 3 perspective view of the partially assembled, flat configuration of the POP display structure of FIG. 2.

The structure is now in a partly assembled configuration 200 as shown in plan view in FIG. 2 and in isometric view in FIG. 3. The sleeve side portions 104 and 106 (as designated by arrows at the bottom of FIG. 2) have been folded to the back and out of sight, along fold lines 114 and 116 respectively. For illustration purposes, notations "a" and "b" are again shown at the points on the inner slider just above the points at which the top ends of support arms 137 and 139 respectively are glued to corresponding support tabs 157 and 159 (which are hidden in FIGS. 2 and 3). The partly assembled structure 200 is in a durable, compact (flat) configuration well suited to shipping and handling.

Upon receipt and unpacking at the place of intended use, such as a retail store, the partly assembled structure 200 may be converted into a completely assembled structure 300 as shown in an isometric view in FIG. 4. The explanation below describes the assembly as if started with the partly assembled structure 200 in a vertical plane (although assembly may also be achieved in a horizontal plane). The completely assembled structure 300 is achieved by simply moving the inner slider 150 relative to outer sleeve 100 (for example by a pulling motion 310 at its upper end, and/or pushing at its lower end). This moving action causes the generally flat rectangular portion 152 to move in a substantially parallel plane relative to the outer sleeve 100, and, for each shelf, the support tabs 157 and 159 (shown in exaggerated thickness in FIG. 4) to move with the inner slide 150, and at the same time move the upper ends of support arms 137 and 139 respectively. Thus while the support tabs 157 and 159 move they extend outwardly, with respect to the face of the illustrated outer sleeve, due to their connection to the support arms 137 and 139. The support arms in turn exert a force on front lip 135, moving it outwardly and causing ledge 132 to rotate along path 315 to an approximately horizontal position as shown in FIG. 4. This is accompanied by an unfolding action about front fold line 134, creating an outward facing horizontal corner, and also by an unfolding action about back fold line 131, creating an inward facing horizontal corner. The finished structure 300 thus comprises a portion of components still in the original vertical plane, and also out of the vertical plane, one or more shelves as characterized by the approximately horizontal ledge(s) 132, along with their corresponding support arms 137 and 139 and front lip 135.

Figure 5:
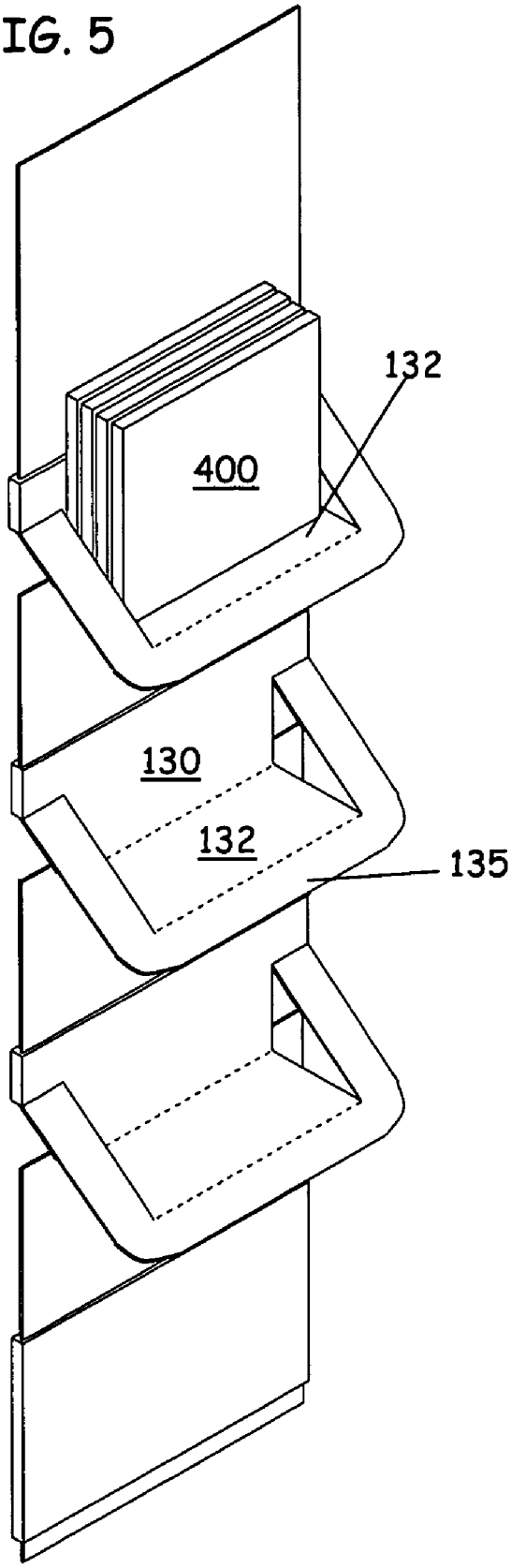
FIG. 5 is a perspective view of the fully assembled configuration of the POP display structure, containing optical media upon one of the shelves.

FIG. 5 shows the completed assembly, now holding on the ledge (132) of the top shelf a number of items such as optical media 400, for example approximately square CD cases. The dimensions of the structure may be planned to accommodate other items in other configurations. For example, by changing the vertical spacing between ledges, the shelves may hold taller items such as DVD clamshell cases, for example the DVD case made by AMARAY. The shelf depth (from back surface 130 to front lip 135) may be increased by design of blanks 100 and 150 in order to hold items in a "bookshelf" orientation (spine forward) instead of the face-forward orientation of FIG. 5.

The completed assembly 300 may be held in a rack support, or may be hung from a hook or pegboard, or attached to a surface such as a wall, display end panel, or the like.

Regarding the exemplary embodiment described above with regard to FIGS. 1-5, the support arms 137, 139 extend above the shelf 132 and are in tension when a load is applied to the shelf 132. In another exemplary embodiment, not illustrated, a shelf 132 extends outwardly from the outer sleeve 102 and is attached to support arms 137, 139 that extend under the shelf 132 and are in compression, rather than above the shelf and in tension. In another exemplary embodiment, some pairs of support arms are in tension while others are in compression. In another exemplary embodiment, not illustrated, only a single support arm is used, that support arm being positioned and extending substantially from the center of the lip 135 to an engaging tab 157 positioned substantially in the center of the outer sleeve 102.

Referring momentarily to FIG. 1 and with regard to yet another alternative embodiment, not illustrated, the sleeve side portions 104 and 106 may be substituted by spaced apart receiving channels (illustrated by the present fold lines 114, 116) that are configured to slidably receive the inner slider blank 150. As understood by one skilled in the art, the receiving channels may be constructed from various materials including wood, plastic, metal, paperboard, combinations thereof and the like, and be of various configurations and cross-sectional profiles, including "C" "L" "T" "Z", combinations thereof and the like, and be of various lengths, as needed for the sleeve 102 to slidably receive the slider blank 150.

Whilst the above embodiments describe a structure comprising a paperboard POP display with three shelves capable of holding optical media, the specific structure is not limited to paperboard, nor is it limited to three shelves, nor to holding optical media.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications and combination may be made to the above-described embodiments without departing form the scope of the claims. All such variations, modifications, and combinations are included herein by the scope of this disclosure of the following claims.

The invention claimed is:

1. A point of purchase display structure (300), comprising:

an outer sleeve (100) configured to slidably engage an inner panel (150);

at least two shelves (132) hingedly attached to said outer sleeve (100), and each shelf including at least one support arm (137, 139);

said inner panel (150) having at least one hingedly attached support tab (157, 159) for each shelf; and said at least one support arm (137, 139) is attached to said at least one support tab (157, 159).

2. The display structure of claim 1, comprised of a sheet material.

3. The display structure of claim 2, wherein said sheet material is paperboard, cardboard, plastic sheet, or combinations thereof.

4. The display structure of claim 1, capable of being partly assembled in a generally flat configuration for shipping.

5. The display structure of claim 1, capable of being completely assembled to a finished configuration by sliding said inner panel (150) within said outer sleeve (100), creating said at least two shelves (132) by folding about at least one fold line (114, 116) upon said outer sleeve (100) corresponding to each of said shelves (132).

6. The display structure of claim 1, wherein each of said shelves (132) comprises an approximately horizontal ledge supported by at least one support arm (137, 139).

7. A method of forming a display structure having at least one shelf, the method comprising:

providing a slider blank (150) of sheet material, having for said at least one shelf at least one support tab (157, 159) hingedly attached to said slider blank (150) along a first fold line (156);

providing a sleeve blank (100) of sheet material, having a central area (102) and two side areas (104, 106) hingedly attached to said central area (102), and having for said at least one shelf a ledge area (132) with two side edges, a rear hinged attachment (131) to said sleeve blank (100), and a front hinged attachment (134) to a lip (135), said lip (135) being attached to a first end of at least one support arm (137, 139) adjacent said ledge (132);

folding said side areas (104, 106) of said sleeve blank (100) to form a sleeve at least partly enclosing said slider blank (150) within said sleeve (100), attaching a second end of said at least one support arm (137, 139) to said at least one support tab (157, 159), adjusting said slider blank (150) within said sleeve (100), thereby causing said support tab (157, 159) to move said attached support arm (137, 139), said support arm in turn moving said lip (135) and causing said ledge area (132) to move out of the plane of said sleeve (100), along said rear hinged attachment, thereby forming said at least one shelf.

8. The method of claim 7, wherein said sheet material is paperboard, cardboard, plastic sheet, or combinations thereof.

9. The method of claim 7, further comprising a step of shipping said display structure in a generally flat configuration.

10. A display structure with at least one shelf, comprising:

a slider blank (150) of sheet material, having for said at least one shelf at least one support tab (157, 159) hingedly attached to said slider blank (150) along a first fold line (156);

a sleeve blank (100) of sheet material, having a central area (102) and two side areas (104, 106) hingedly attached to said central area (102), and having for said at least one shelf a ledge area (132) with two side edges, a rear hinged attachment (131) to said sleeve blank (100), and a front hinged attachment (134) to a lip (135), said lip (135) being attached to a first end of at least one support arm (137, 139) adjacent said ledge (132);

a second end of said at least one support arm (137, 139), said second end being attached to said at least one support tab (157, 159), wherein said side areas (104, 106) of said sleeve blank (100) are folded to form a sleeve at least partly enclosing said slider blank (150) within said sleeve (100), wherein said slider blank (150) when slidably moved within said sleeve (100), causes said support tab (157, 159) to move said attached support arm (137, 139), said support arm in turn moving said lip (135) and causing said ledge area (132) to move out of the plane of said sleeve (100), along said rear hinged attachment, thereby forming said at least one shelf.

11. The display structure of claim 10, wherein said sheet material is paperboard, cardboard, plastic sheet, or combinations thereof.

12. The display structure of claim 10, capable of being partly assembled in a generally flat configuration for shipping.

13. A display structure (300), comprising:

an outer sleeve (100) configured to slidably engage a generally flat inner panel (150);

at least one shelf (132) hingedly attached to said outer sleeve (100), the shelf including at least one support arm (137, 139);

said generally flat inner panel (150) having at least one hingedly attached support tab (157, 159) associated with the shelf; and said at least one support arm (137, 139) is attached to said at least one support tab (157, 159).

14. The display structure of claim 13, comprised of a sheet material.

15. The display structure of claim 14, wherein said sheet material is paperboard, cardboard, plastic sheet, or combinations thereof.

16. The display structure of claim 13, capable of being partly assembled in a generally flat configuration for shipping.

17. The display structure of claim 13, capable of being completely assembled to a finished configuration by sliding said inner panel (150) within said outer sleeve (100), creating said at least one said shelf (132) by folding about at least one fold line (114, 116) upon said outer sleeve (100) corresponding to each said shelf (132).

18. The display structure of claim 13, wherein said shelf (132) comprises an approximately horizontal ledge supported by said at least one support arm (137, 139).

* * * * *